US007921567B2

(12) United States Patent
Trbovich, Jr.

(10) Patent No.: US 7,921,567 B2
(45) Date of Patent: Apr. 12, 2011

(54) BAYONET HAVING A SERRATED EDGE AND A BALANCED POSITIONING ACCESS POINT

(75) Inventor: Nicholas D. Trbovich, Jr., Orchard Park, NY (US)

(73) Assignee: The Ontario Knife Company, Franklinville, NY (US)

( * ) Notice: Subject to any disclaimer, the term of this patent is extended or adjusted under 35 U.S.C. 154(b) by 0 days.

(21) Appl. No.: 11/343,834

(22) Filed: Jan. 31, 2006

(65) Prior Publication Data

US 2006/0265884 A1 Nov. 30, 2006

Related U.S. Application Data

(63) Continuation-in-part of application No. 10/865,126, filed on Jun. 10, 2004, now abandoned.

(60) Provisional application No. 60/478,140, filed on Jun. 12, 2003.

(51) Int. Cl.
*B26B 3/00* (2006.01)

(52) U.S. Cl. ..... 30/295; 30/340; 7/134; 42/86

(58) Field of Classification Search ..... 30/290, 30/295, 340, 342; 42/86; 7/134
See application file for complete search history.

(56) References Cited

U.S. PATENT DOCUMENTS

| | | | | | |
|---|---|---|---|---|---|
| 1,553,985 | A * | 9/1925 | Ciesnierski | 42/86 |
| 2,333,379 | A * | 11/1943 | Johnson, Jr. | 42/86 |
| 2,367,212 | A * | 1/1945 | Haag | 42/86 |
| 3,076,280 | A * | 2/1963 | Bervoets | 42/86 |
| 3,592,247 | A * | 7/1971 | Solf | 81/177.1 |
| 3,842,458 | A * | 10/1974 | Bauer | 7/134 |
| 4,821,356 | A * | 4/1989 | Finn | 7/134 |
| D323,095 | S * | 1/1992 | Usbeck | D7/395 |
| 5,556,092 | A * | 9/1996 | Theken | 473/538 |
| 5,594,967 | A * | 1/1997 | Morton et al. | 7/134 |
| 5,724,739 | A * | 3/1998 | Hutton | 30/356 |
| 5,966,818 | A * | 10/1999 | Spirer | 30/167 |
| D420,556 | S * | 2/2000 | Don | D8/10 |
| 6,209,250 | B1 * | 4/2001 | Mills | 42/53 |
| 6,725,545 | B2 | 4/2004 | Frank | 42/86 |
| 6,725,593 | B1 * | 4/2004 | Harris | 42/86 |
| 6,726,868 | B1 * | 4/2004 | Panfili et al. | 264/247 |
| D531,310 | S * | 10/2006 | Wolter et al. | D24/133 |
| 2002/0104182 | A1 * | 8/2002 | Panfili et al. | 15/236.01 |
| 2003/0159220 | A1 * | 8/2003 | Trbovich et al. | 7/158 |

* cited by examiner

*Primary Examiner* — Hwei-Siu C Payer
(74) *Attorney, Agent, or Firm* — Jaeckle Fleischmann & Mugel, LLP

(57) ABSTRACT

A bayonet includes: a blade having a sharpened portion and a tang integral with the sharpened portion; a handle that encloses the tang of the blade and has a first end proximate to the sharpened portion of the blade and a second end proximate to an end of the tang of the blade; a guard between the sharpened portion of the blade and the first end of the handle; a clip that is affixed to the second end of the handle and is further affixed to the end of the tang of the blade; and a positioning access point on the handle proximate to the second end of the handle. A bayonet is further provided that includes: a blade having a sharpened portion with a lower sharpened edge that is serrated and a tang integral with the sharpened portion; a handle that encloses the tang of the blade and has a first end proximate to the sharpened portion of the blade and a second end proximate to an end of the tang of the blade; a guard between the sharpened portion of the blade and the first end of the handle; and a clip that is affixed to the second end of the handle and is further affixed to the end of the tang of the blade.

2 Claims, 5 Drawing Sheets

BAYONET HAVING A SERRATED EDGE AND A BALANCED POSITIONING ACCESS POINT

CROSS-REFERENCE TO RELATED APPLICATIONS

This application is a continuation-in-part of prior U.S. application Ser. No. 10/865,126, filed on Jun. 10, 2004, now abandoned, which claims priority of U.S. Provisional Application No. 60/478,140, filed Jun. 12, 2003.

STATEMENT REGARDING FEDERALLY SPONSORED RESEARCH OR DEVELOPMENT

Not applicable.

BACKGROUND OF THE INVENTION

Serrated portions of the sharpened edge of knives are common for enhancing the ability of the knife to cut certain materials such as rope and aircraft aluminum. The Geneva Convention prohibits use of bayonets having a serrated top edge; however bayonets having a serrated bottom edge or a partially serrated bottom edge is desired.

Further, a user of a bayonet often needs to rapidly reorient the bayonet. However, such reorientation makes it easy for the user to loose his/her grip on the handle of conventional bayonets. Therefore a bayonet having a positioning access point is desired in the art.

BRIEF SUMMARY OF THE INVENTION

A bayonet is provided which comprises: a blade having a sharpened portion and a tang integral with the sharpened portion; a handle enclosing the tang of said blade, said handle having a first end proximate to the sharpened portion of said blade and a second end proximate to an end of the tang of said blade; a guard between the sharpened portion of said blade and the first end of said handle; a clip affixed to the second end of said handle, said clip being further affixed to the end of the tang of said blade; and a positioning access point on said handle proximate to the second end of said handle.

A bayonet is further provided which comprises: a blade having a sharpened portion and a tang integral with the sharpened portion, the sharpened portion including a lower sharpened edge which is serrated; a handle enclosing the tang of said blade, said handle having a first end proximate to the sharpened portion of said blade and a second end proximate to an end of the tang of said blade; a guard between the sharpened portion of said blade and the first end of said handle; and a clip affixed to the second end of said handle, said clip being further affixed to the end of the tang of said blade.

BRIEF DESCRIPTION OF THE SEVERAL VIEWS OF THE DRAWINGS

The above-mentioned and other features and advantages of this invention, and the manner of attaining them, will become appreciated and be more readily understood by reference to the following detailed description of the embodiments of the invention in conjunction with the accompanying drawings, wherein.

Corresponding reference characters indicate corresponding parts throughout the several views. The exemplifications set out herein illustrate the preferred embodiments of the invention and such exemplifications are not to be construed as limiting the scope of the invention in any manner.

DETAILED DESCRIPTION OF THE INVENTION

Figure 1:
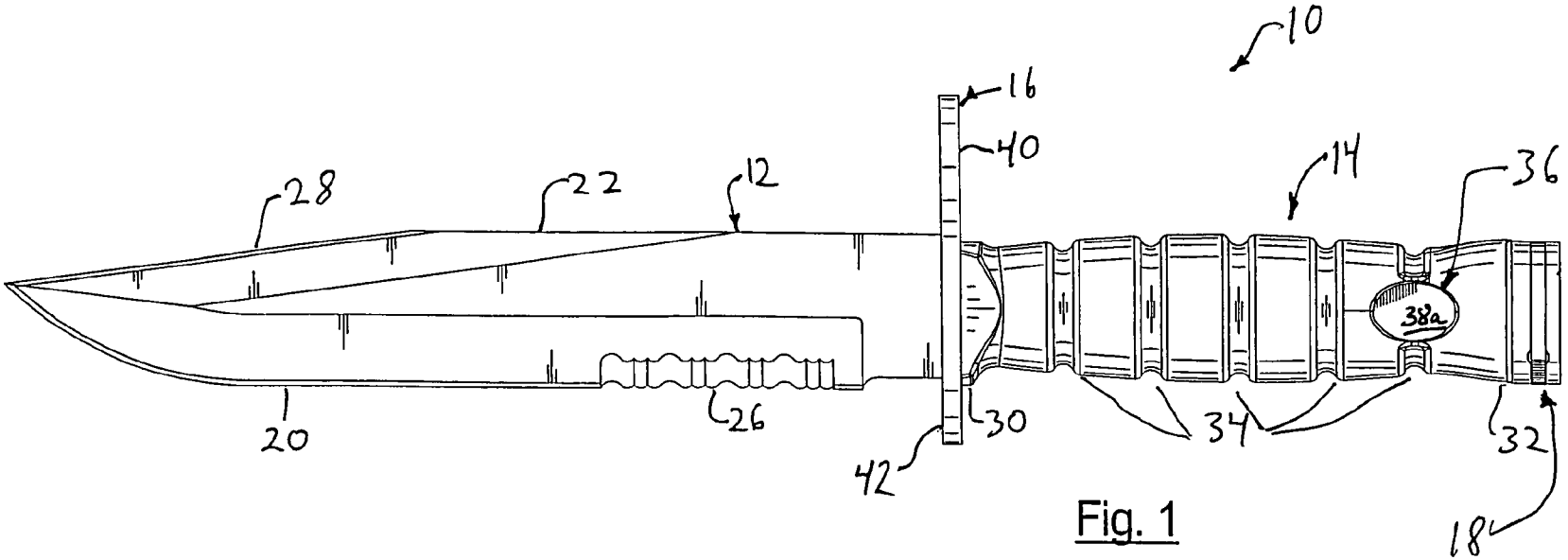
FIG. 1 is a side view of the bayonet of the present invention.

Referring to FIG. 1, there is shown the bayonet of the present invention. The bayonet 10 includes a blade 12, a handle 14, a guard 16, and a clip 18.

Figure 2:
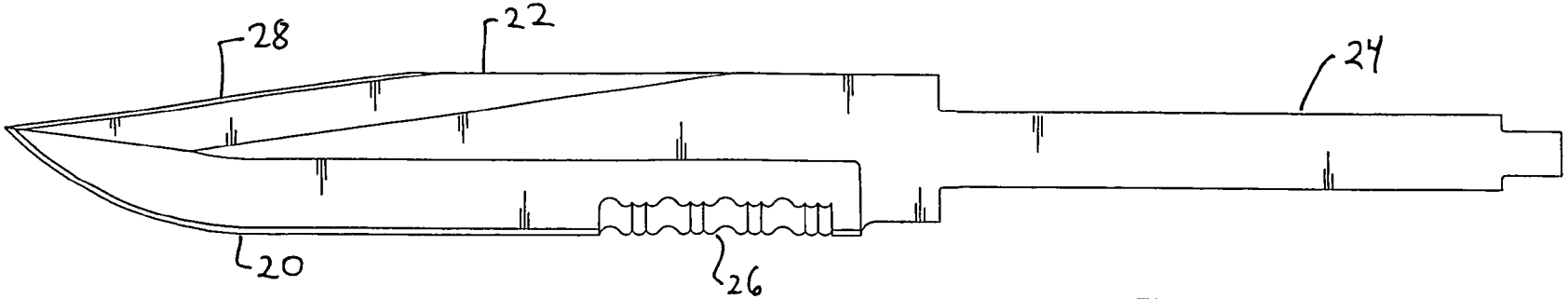
FIG. 2 is a side view of the blade of FIG. 1.

Referring to FIGS. 1 and 2, the blade 12 includes a bottom edge 20, a top edge 22, and a tang 24 which tans 24 and blade 12 are formed from one and the same piece of material. The bottom edge 20 is sharpened along its length and includes a serrated portion 26. The serrated portion 26 improves the ability of the bayonet to cut through materials such as rope and aircraft grade aluminum. The top edge 22 includes a sharpened portion 28.

Figure 3:
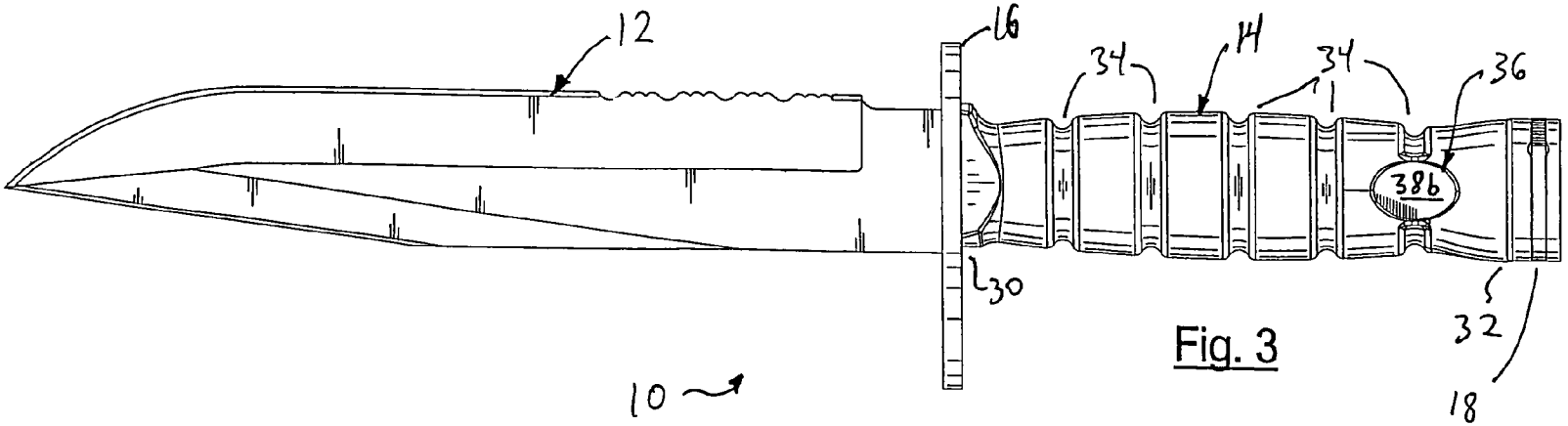
FIG. 3 is an opposite side view of the bayonet of FIG. 1.
Figure 4:
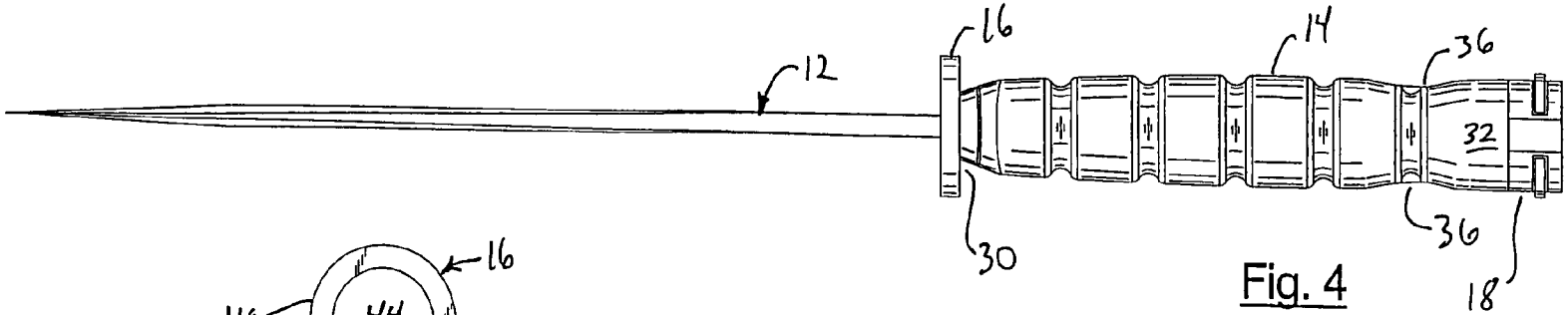
FIG. 4 is a top view of the bayonet of FIG. 1.

Referring now to FIGS. 1 and 3, the handle 14 includes a first end 30, a second end 32, grooves 34, and a positioning access point 36. Grooves 34 improve the grip of the handle 14 and reduce the weight of the handle 14. The positioning access point 36 is located proximate to the second end 32 and is marked by recessed logos 38*a* and 38*b* on either side of handle 14. As shown in FIG. 4, the positioning access point 36 comprises an indented portion of the handle 14. Further, the positioning access point 36 is located at a natural pivot point of the bayonet 10. Thus, when the index finger or the middle finger and the thumb are placed on opposing sides of the positioning access point 36, the bayonet 10 pivots naturally about the positioning access point 36 between the finger and the thumb.

Figure 5:
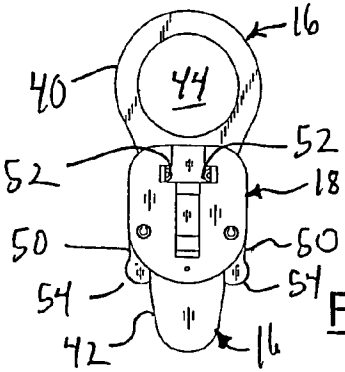
FIG. 5 is an end view of the bayonet of FIG. 1.

Referring to FIGS. 1 and 5, the guard 16 includes a top portion 40 and a bottom portion 42. The top portion 40 is proximate to the top edge 22 of the blade 12 and extends above the handle 14. The top portion 40 further includes a bore 44 having a clearance fit with a rifle barrel. The bottom portion 42 extends below the handle 14. Thus top portion 40 and bottom portion 42 prevent the user's hand from slipping onto the blade 12 during use.

The clip 18 is a quick-disconnect attachment for affixing the bayonet 10 to a rifle. The clip 18 includes levers 50 having a hook end 52 and a finger grip end 54. The levers 50 pivot about a fulcrum between the finger grip end 54 and the hook end 52 when the finger grip ends 54 are compressed thereby releasing the clip 18. The clip 18 is affixed to the second end 32 of the handle 14 by rivets, screws, epoxy, or other suitable fastening means. The tang 24 is affixed to the clip 18 by welding, epoxy, or other suitable fastening means. The tang 24 is preferably peened and placed in tension between the guard 16 and the clip 18. Thus, the handle 14 is placed under a compressive force via the first end 30 and the second end 32.

In use, the bayonet 10 often must be reoriented. For example, the bayonet 10 is often removed from a scabbard in the upright position but must be attached to a rifle in the inverted position. Therefore, it would be an advantage to be able to quickly invert the bayonet 10. Because the positioning access point 36 is indented and marked by recessed logos 38*a* and 38*b*, the index finger (or middle finger) and thumb naturally slide along the bayonet 10 from the first end 30 to the positioning access point 36. Once the finger and thumb are in opposing positions on the positioning access point 36, the bayonet 10 pivots quickly and easily from the upright position to the inverted position. Rapid reorientation of the bayonet 10 is also often required in combat.

Although the handle 14 is shown in the drawings having a double belly design, a single belly design may also be used. The material of the handle 14 is preferably DYNAFLEX G7980™ however any material having suitable strength may be used. DYNAFLEX G7980™ is a trademark of GLS Corporation and is a thermoplastic elastomer compound made with KRATON® Polymer. KRATON® is a registered Trademark of KRATON Polymers U.S. LLC. KRATON® polymers and compounds may contain combinations of styrene-butadiene-styrene, styrene-isoprene-styrene, styrene-ethylene/butylene-styrene, and styrene-ethylene/propylene. The handle 14 may be textured to improve the user's grip. The texturing may be diamond texturing as shown in FIGS. 6 and 7 or the handle 14 may be otherwise suitably knurled.

Figure 6:
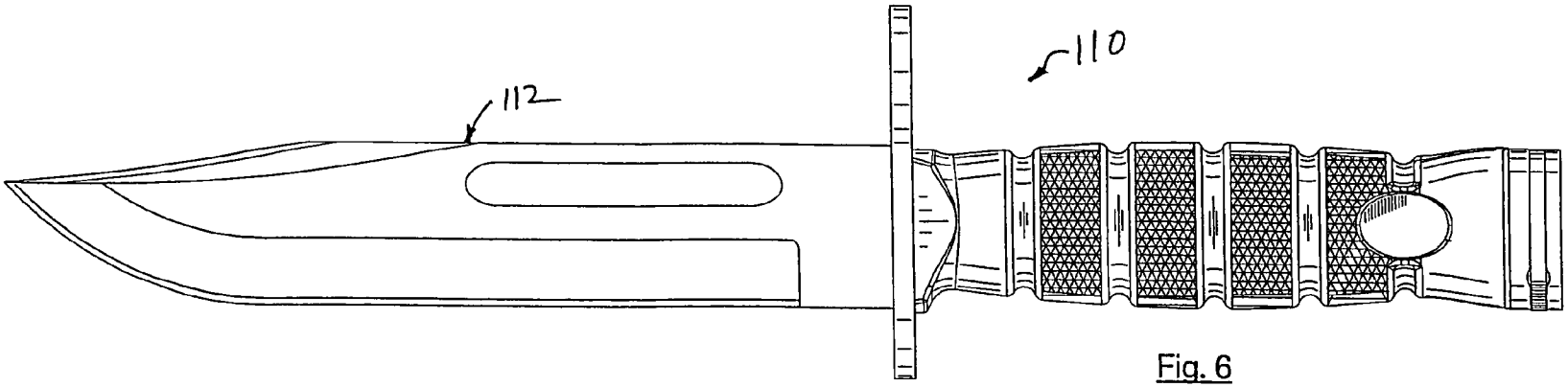
FIG. 6 is a side view of the bayonet of the present invention having an alternate blade shape.
Figure 7:
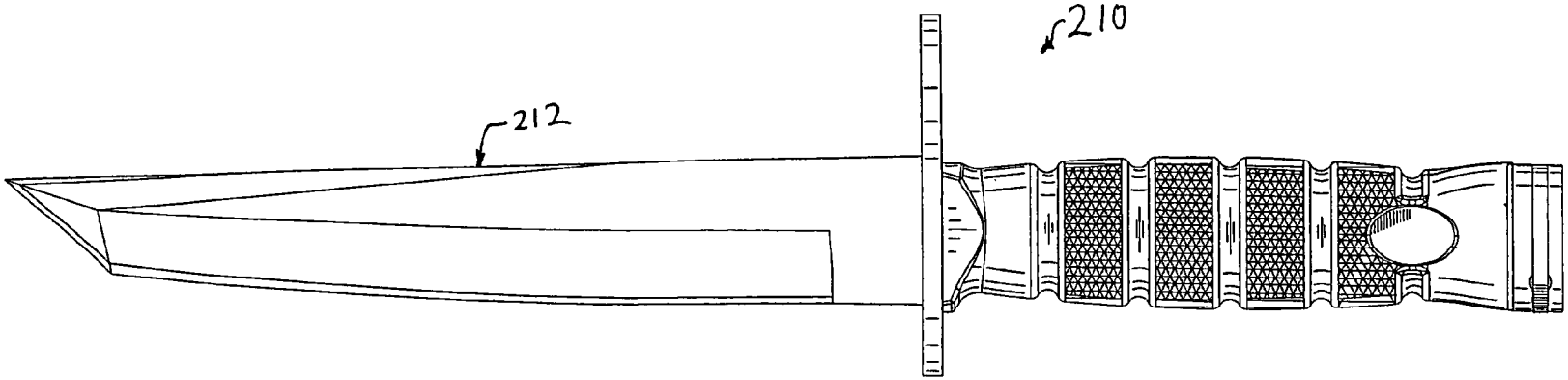
FIG. 7 is side view of the bayonet of the present invention having a further alternate blade shape.

As shown in FIGS. 6 and 7, bayonets 110 and 210 have alternately shaped blades 112 and 212, respectively. The alternately shaped blades 112 and 212 may also include serrations.

Figure 9:
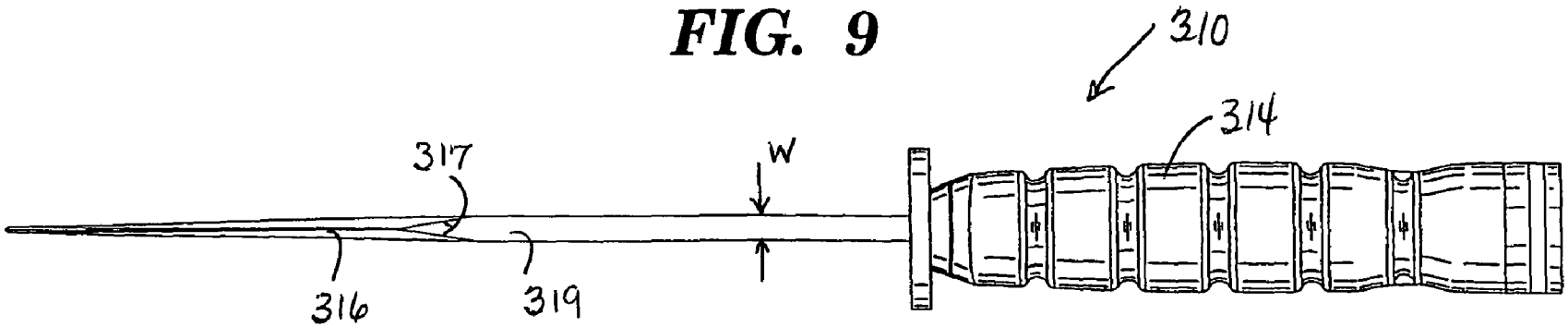
FIG. 9 is a top plan view of FIG. 8.
Figure 8:
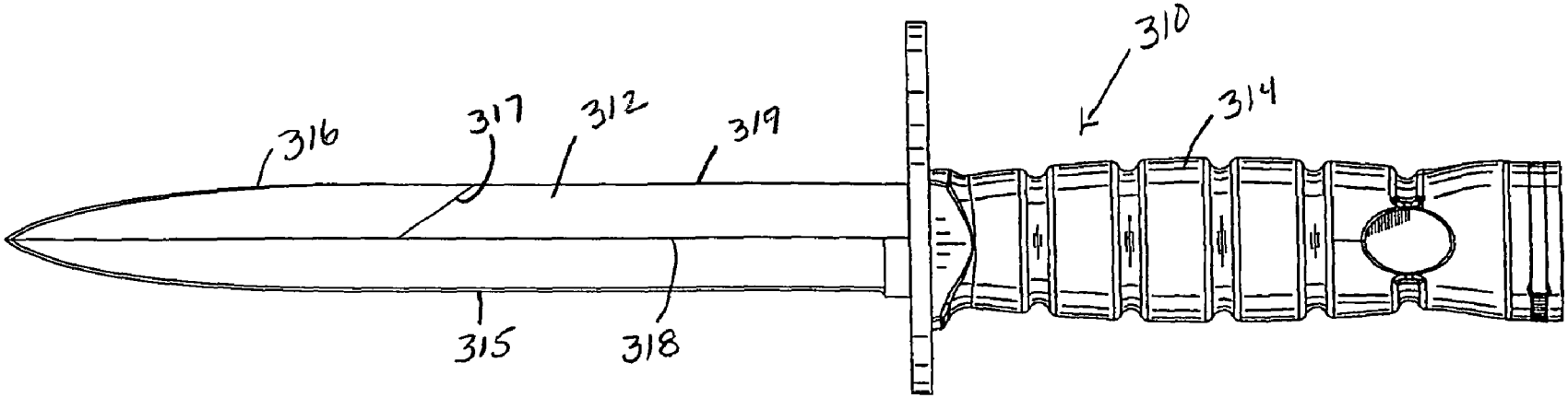
FIG. 8 is a side view of the bayonet of the present invention having an alternate blade shape.

As shown in FIGS. 8 and 9, bayonet 310 has an alternately shaped blade 312 having lower and upper sharpened edges 315, 316, respectively. Blade 312 is of substantially constant width "w" from the handle 314 to the sharpened edge 316. A taper line 317 extends diagonally rearward from the blade midline 318 to the top edge 319 of blade 312. It is understood that all or any combination of the features of bayonet 10 described above may be incorporated into bayonet 310 as well.

The invention claimed is:

1. A method of handling a bayonet comprising the step of:

a) providing a bayonet comprising:

a blade comprising a sharpened portion and a tang integral with the sharpened portion, such that the tang and the sharpened portion of the blade are from one-piece;

a handle enclosing the tang of said blade, said handle having a first end proximate to the sharpened portion of said blade and a second end proximate to an end of the tang of said blade;

a guard between the sharpened portion of said blade and the first end of said handle; and a clip affixed to the second end of said handle, said clip being further affixed to the end of the tang of said blade;

b) providing first and second positioning access pivot points at a natural pivot point of the bayonet and on opposing sides of said handle proximate to the second end of said handle, wherein said first and second positioning access pivot points are in the form of first and second indentations; and c) manually reorienting said bayonet between an upright position and an inverted position by placing a user's thumb and finger on said first and second indentations, respectively, and pivoting said bayonet thereabout.

2. The method of claim 1 and further comprising the step of forming a logo in at least one of said first and second positioning access points.

* * * * *